United States Patent [19]

Norton

[11] Patent Number: 4,810,102

[45] Date of Patent: Mar. 7, 1989

[54] UNIVERSAL SPORT BAG

[75] Inventor: Don S. Norton, Clinton, Miss.

[73] Assignee: Brell Mar Products, inc., Clinton, Miss.

[21] Appl. No.: 115,376

[22] Filed: Nov. 2, 1987

[51] Int. Cl.[4] ..... B65D 30/00

[52] U.S. Cl. ..... 383/4; 383/13; 150/108; 190/116; 224/151

[58] Field of Search ..... 383/4, 13, 16; 224/151, 224/153; 150/107, 108; 190/116, 117

[56] References Cited

U.S. PATENT DOCUMENTS

| | | | |
|---|---|---|---|
| 2,515,316 | 7/1950 | Schjelderup | 383/16 X |
| 3,346,155 | 10/1967 | Oechsle | 383/13 X |
| 4,515,300 | 5/1985 | Cohen | 224/151 |
| 4,566,130 | 1/1986 | Coates | 190/117 X |

FOREIGN PATENT DOCUMENTS

| | | | |
|---|---|---|---|
| 0818447 | 9/1937 | France | 383/13 |
| 0186977 | 10/1936 | Switzerland | 224/153 |

*Primary Examiner*—Stephen Marcus
*Assistant Examiner*—Nova Stucker
*Attorney, Agent, or Firm*—Nixon & Vanderhye

[57] ABSTRACT

An especially adapted sport bag having a carrying strap which is capable of supporting the bag in either one-, two- or three-point contact and thus permits the bag to be utilized as either a waist-, shouder-, or back-pack, respectively. The bag/strap configurations are readily converted by a user one to another so that it is "universally" adapted for various modes of transport.

9 Claims, 3 Drawing Sheets

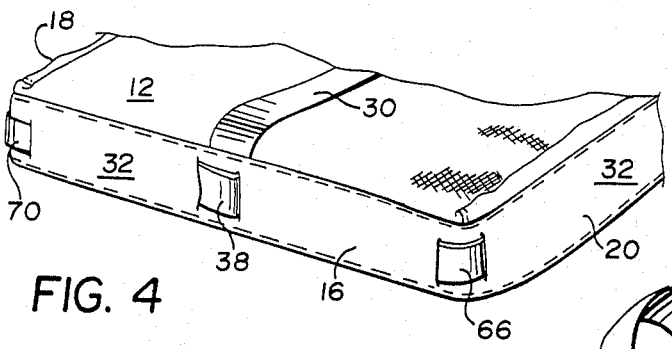
FIG. 4
FIG. 5
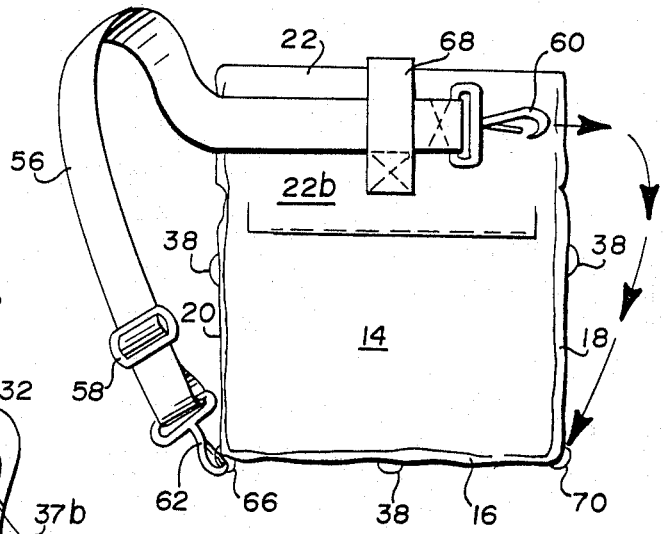
FIG. 6
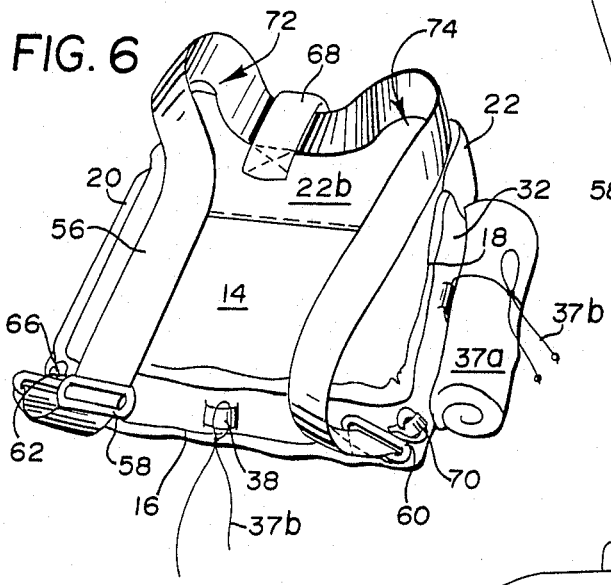
FIG. 7
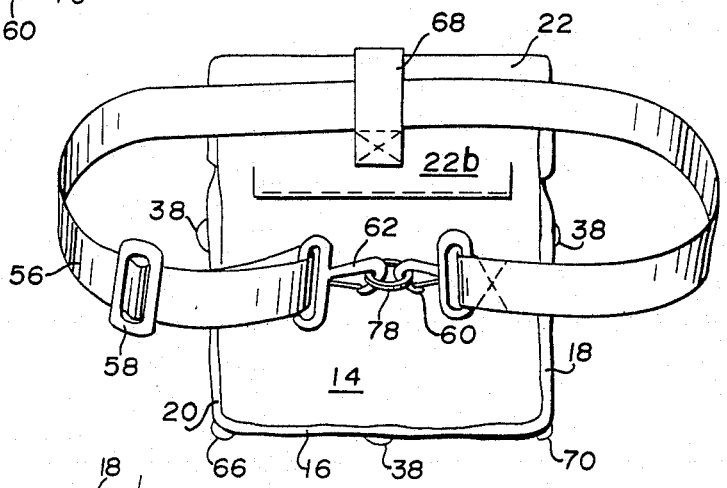
FIG. 8
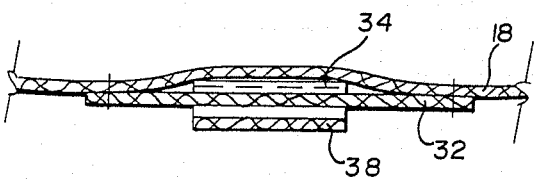
FIG. 9
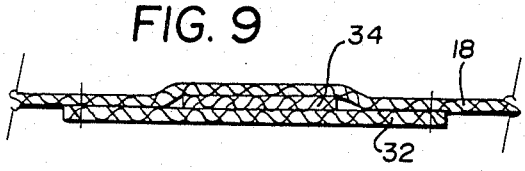

UNIVERSAL SPORT BAG

FIELD OF THE INVENTION

This invention relates to sport bags and, more specifically, to sport bags which employ a carrying strap. The invention, in a particularly preferred form, is embodied in an especially adapted sport bag having a carrying strap which is capable of supporting the bag in either one-, two- or three-point contact and thus permits the bag to be utilized as either a waist-, shoulder-, or back-pack, respectively. In this manner, the invention is "universally" adapted for various modes of transport by the user.

BACKGROUND AND SUMMARY OF THE INVENTION

Bags of a variety of sizes and shapes have been employed in the pursuit of sport and recreation. For example, in the hunting and fishing sports, it is most convenient for the hunter and fisherman to use a bag during their expeditions for carrying food and provisions, equipment, and, hopefully, the resulting game. Bags or packs have, however, become very specialized so that, for example, a bag for carrying one's game may not be suitable for carrying sport equipment, such as ammunition, tackle, and the like. Moreover, bags typically are incapable of being toted or carried in more than one fashion—that is, a back-pack is typically only capable of being comfortably carried upon a user's back; a shoulder-pack is typically only capable of being carried upon a user's shoulder; and a waist-pack is typically only capable of being carried upon a user's waist. Thus, for example, when a user tires of carrying a conventional back-pack upon his back, there is no provision for converting it to either a waist- or a shoulder-pack. This inability of conventional packs limits their useful versatility, and, in addition, forces the sportsman to purchase multiple "specialty" packs.

What has been needed, therefor, is a sport pack which is universal—that is, convertible into use as either a shoulder-, waist- or back-pack. In accordance with this invention, such a unversally adapted sport pack is provided.

The invention, in a particularly preferred embodiment, is comprised of a pack having front, back, side and bottom panels connected to one another (e.g., preferably by means of stitching) so as to define an interior carrying space. A shoulder strap is also provided and is adapted to being connected to the pack in a number of configurations (as will be explained in greater detail below) so as to permit the pack to be carried via the strap in a corresponding number of ways. Means are thus provided so that the pack and strap can be coupled to one another in a variety of supporting configurations. One such configuration is where the pack is supported by the strap in "one-point" relationship so that the strap may encircle a user's waist and thus the pack/strap will function as a waist pack. Another configuration is where the strap supports the pack at "two points" of contact so that the pack/strap will function as a shoulder pack. Finally, a "three-point" configuration is provided whereby the strap supports the pack at three points of contact so that the strap forms a pair of arm holes thereby permitting the pack to be carried upon a user's back.

An accessory strap is preferably formed as part of the side and bottom panels of the pack and is rigidly secured at each of its ends to an upper region of a respective side panel. The accesory strap is normally concealed by the side and bottom panels except at locations where it is exposed via a pair of spaced-apart slits formed in the side and/or bottom panels. Since the accessory strap is secured only at each of its ends, the loops are capable of being enlarged (as by drawing in the side and/or bottom panels) so that accessory items may be physically attached thereto.

The sport bag of this invention can be fabricated from any suitable textile material. Considering its intended environment (e.g., the outdoors), it is preferred that fabrics having water-resistant or water-repellant properties be employed.

These and other aspects and advantages of the invention will become more apparent to those skilled in this art after carefully considering the detailed description of the preferred exemplary embodiment thereof which follows.

BRIEF DESCRIPTION OF THE DRAWINGS

Reference will hereinafter be made to the accompanying drawings wherein like reference numerals throughout the various Figures denote like structural elements, and wherein.

FIG. 4 is a bottom view of the sport pack of this invention;

FIG. 5 is a rear perspective view of the sport pack of this invention particularly showing the manner in which the same is modified so as to be supported at three points thereof;

FIG. 6 is a rear perspective view of the sport pack of his invention particularly showing the three-point support configuration thereof;

FIG. 7 is a rear perspective view of the sport pack of this invention particularly showing a one-point support configuration thereof;

FIG. 8 is a cross-sectional view of the sport pack of this invention taken along line 8—8 in FIGURE 1; and FIG. 9 is a cross-sectional view of the sport pack of this invention taken along line 9—9 in FIGURE 1.

DETAILED DESCRIPTION OF THE PREFERRED EXEMPLARY EMBODIMENTS

Figure 1:
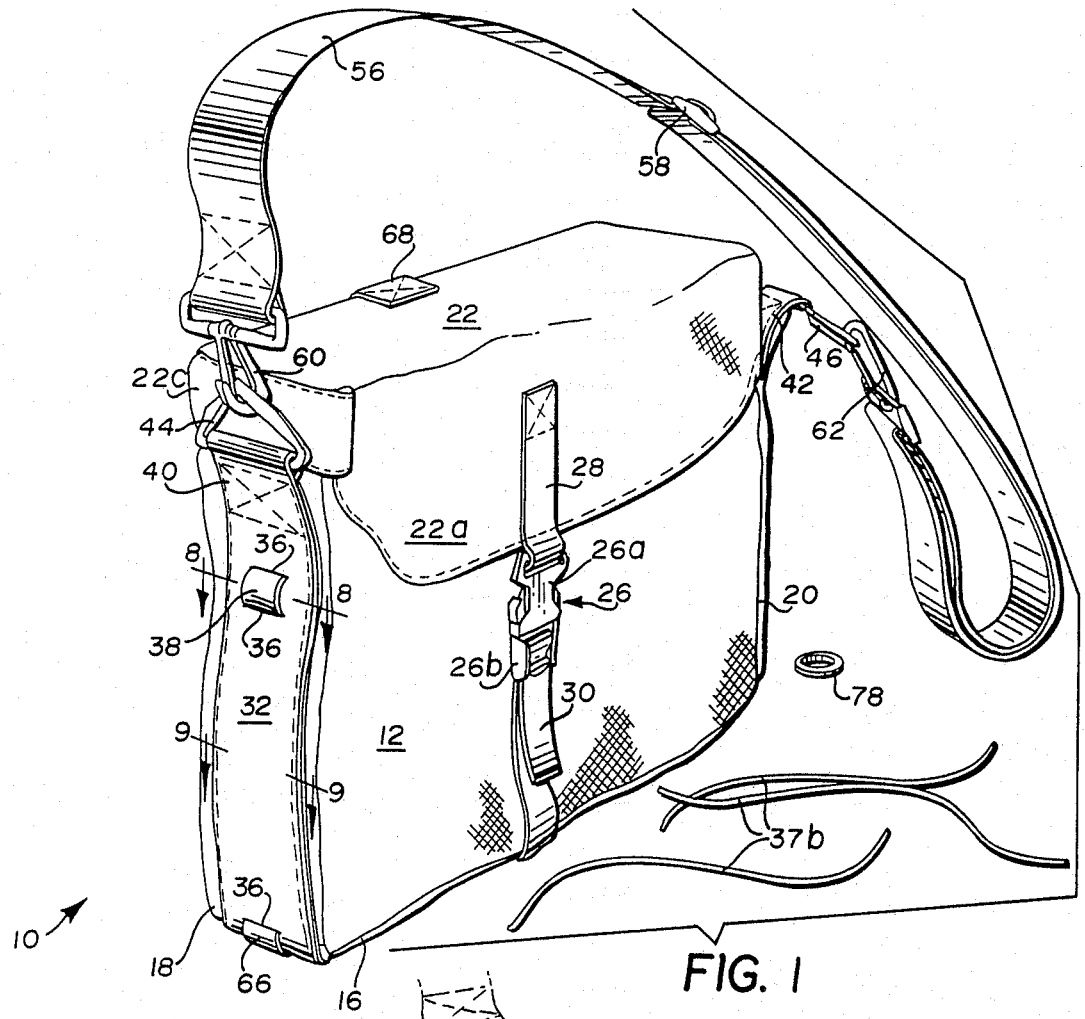
FIG. 1 is a front perspective view of the sport pack of this invention particularly showing a two-point support configuration thereof.
Figure 2:
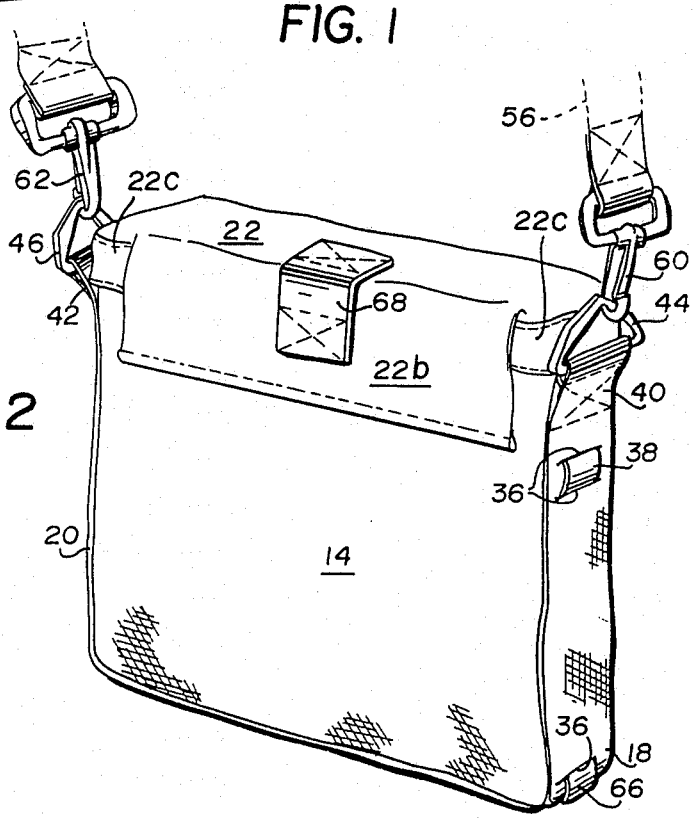
FIG. 2 is a rear perspective view of the sport pack shown in FIG. 1.

A particularly preferred embodiment of the present invention is shown in the accompanying drawing figures. As can be seen with particular reference to FIGS. 1–3, the sport bag 10 is generally comprised with front and back panels 12,14, respectively, a bottom panel 16 and an opposing pair of side panels 18, 20, respectively, which are all preferably formed of a durable fabric (e.g. canvas-like) and are stitched together so as to form an enclosure for carrying articles. A top panel 22 having a front flap **22*a* is connected to back panel 14 via an integral fabric hinge 22*b*. Top panel 22 preferably includes a general U-shaped periphery (i.e. adjacent sides 18 and 20 and backpanel 14) so as to be substantially shape-retaining. One part of a two-part clasp 26 is connected to front flap 22*a* via stitched support web 28 while the other part of clasp 26 is connected to front panel 12 and/or bottom panel 16 via adjustable strap 30 so that the top 22** may be securely closed.

A reinforcement web 32 is stitched along each of its sides and extends continuously along the pair of side panesl 18, 20 and bottom panel 16, respectively. An accessory strap 34 (see FIGS. 8 and 9) is interposed between the web 32 on the one hand and the panels 18, 20 and 16, respectively, on the other hand, and extends through longitudinally spaced apart pairs of slits 36 formed in the web 32 so as to provide accessory "loops" 38 on the visible exterior sides and bottom of the sport bag 10. The accessory strap 34 is fixedly attached at each of its ends (preferably by means of stitching) to loop members 40, 42 in which a respective eyelet 44, 46 is operatively placed. The provision of loops 38 on the exterior of bag 10 thus permits a user to affix articles, equipment and the like (generally designated by numeral 37*a* in FIG. 6) to the bag 10 via separate tie-strings 37*b*. In such a manner, accessory articles may be toted by the users on the exterior of bag 10.

Figure 3:
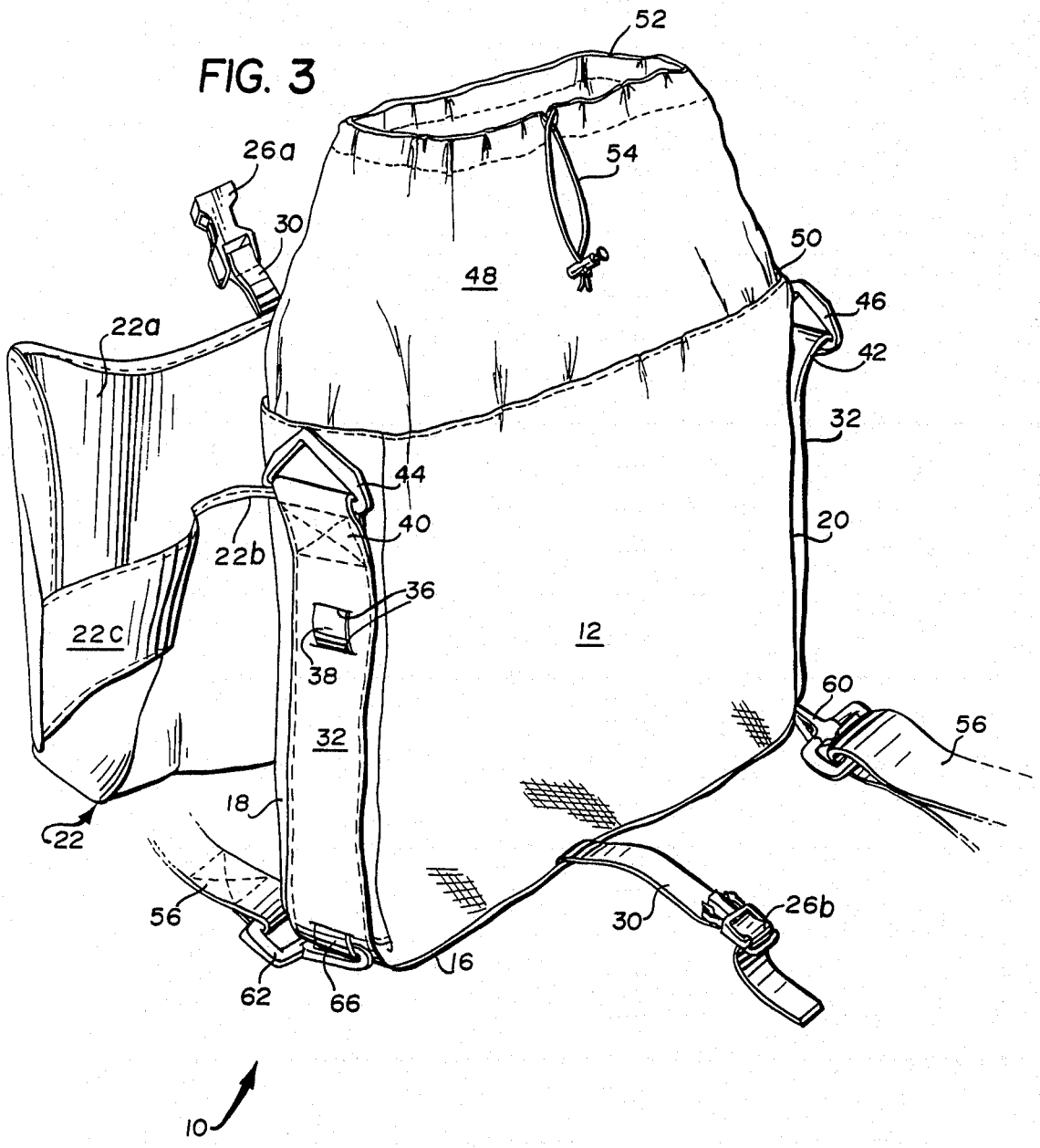
FIG. 3 is a front perspective view of an opened sport pack of this invention particularly showing an interior drawstring liner extending therefrom.

An interior liner 48 is stitched to the periphery of open top 50 of the sport bag 10 and may be extended therefrom in the manner shown by FIG. 3. The upper opening 52 of liner 48 (i.e. opposite to where it is stitched to the bag 10) is preferably provided with a drawstring closure 54. Extension of the liner 48 in the manner shown in FIG. 3 thus serves to increase the carrying capacity of the sport pack 10 while yet protecting the articles being carried therein and/or preventing the articles from spilling therefrom.

A carrying strap 56 includes a conventional friction adjustment bar 58 to permit length adjustment of strap 56. Spring clips 60, 62 are provided at each end of strap 56 for removable attachment to various points of support located on bag 10 (in a manner which will be described in greater detail below). For example, in FIGS. 1 and 2, the clips 60, 62 are depicted as being removeable coupled to eyelets 44, 46, respectively, and thus such a configuration provides "two-point" support on bag 10 so that it may be carried on a user's shoulder.

FIGS. 5 and 6 show a "three-point" support configuration for the bag 10 of this invention—that is, a support configuration whereby the strap 56 is coupled to bag 10 in such a manner that the bag 10 is capable of being carried by a user in the form of a back pack. As is seen, clip 62 is coupled to the bottom corner accessory loop 66 and bar 58/strap 56 is manipulated so as to lengthen the strap 56 to a length sufficient fo permit clip 60 to be threaded through support loop 68 (stitched at each of its ends to top panel 22 at a location so that loop 68 is positioned in the upper midsection of back panel 14) in the manner shown by the arrows in FIG. 5. Clip 60 is thereafter coupled to bottom corner accessory loop 70 so as to form a pair of arm-holes 72, 74 through which a user's arms may be extended so that the strap rests upon the user's shoulders. Thereafter, the bar 58/strap 56 may be adjustably manipulated so that a comfortable fit is selected by the user. In such a manner, the bag 10 of this invention may be carried by the user in the form of a back pack.

Accompanying FIG. 7 shows a "one-point" support configuration for the bag 10 of this invention. As is seen, the strap 56 is lengthened by adjustable manipulation of bar 58/strap 56 so that it is of a sufficient length to encompass a user's waist. Either clip 60 or clip 62 is threaded through support loop 68 and is brought into confronting relationship with the other clip 60 or 62—that is, so that the clips 60, 62 are located to the front of the user and so that the strap 56 encircles the user's waist. Clips 60 and 62 are then coupled one to another either directly or, more preferred, via a separate coupling ring 78. As can be appreciated, the support loop 68 in the configuration shown in FIG. 7 provides a single region of support (i.e. one-point support) for bag 10 upon strap 56, and thus the bag 10 may be carried as a waist pack.

As the reader will now undoubtedly appreciate, the present invention provides the means by which the support configuration therefore may be readily converted by a user between a plurality of such configurations, and thus the sport bag 10 of this invention is "universal in nature—that is, is convertible by a user from one support configuration to another.

Thus, while the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A sport bag comprising, in combination:

a bag comprising front and back panels, a pair of side panels, and a bottom panel joined to one another so as to establish an open-ended interior space for carrying articles;

a strap for carrying the bag; and means for coupling said bag and strap so that said bag is supportable by a user via said strap;

said coupling means coupling said strap to said bag such that said bag is supportable by said strap in one of a plurality of configurations selected by the user, said coupling means facilitating conversion between one and another of said support configurations, said sport bag also including an accessory strap joined at one and another of its ends to one and another of said side panels, respectively, said accessory strap extending between said joined one and another ends closely adjacent to said pair of side panels and to said bottom panel so as to be concealed thereby, and wherein at least one of said side panels and said bottom panel includes plural slits spaced-apart in the direction of said accessory strap, said accessory strap being extended through said slits so as to expose regions thereof corresponding in number to said plural pairs of slits, whereby items may be attached to said exposed regions.

2. A pack for carrying articles comprising;

a bag including front and back panels, a pair of side panels, and a bottom panel joined to one another so as to establish an interior space for carrying articles;

a strap;

coupling means collectively provided with said bag and strap for supporting said bag by said strap so that it may be carried by a user;

said coupling means including at least first, second and third support regions of said bag mateable with said strap in such a manner that said bag portion is supportable by said strap in first, second and third support configurations, respectively, wherein said first support region includes a support loop fixed to said back panel substantially centrally at an upper region thereof;

said second support region includes a pair of eyelets each of which is fixed to an upper region of a respective one of said side panels;

said third support region includes said support loop and a pair of accessory loops fixed to a lower region of a respective one of said side panels; and wherein (a) said strap in said first support configuration is removably connected to said support loop so as to support said bag along a single point;

(b) opposing ends of said strap in said second support configuration are each removably connected to a respective one of said eyelets so as to support said bag along two points; and (c) said strap in said third support configuration is removably attached to said support loop with each end of said strap being removably connected to a respective one of said accessory loops so as to support said bag along three points; and wherein said coupling means facilitates conversion by said user between said first, second and third support configurations by allowing the user to remove the strap from its connection with the bag and then to reattach said strap thereto, whereby the user may select the manner in which said bag is carried.

3. A sport bag comprising front and back panels, a pair of side panels, and a bottom panel joined to one another so as to establish an open-ended interior space for carrying articles, said sport bag also including an accessory strap joined at one and another of its ends to one and another of said side panels, respectively, said accessory strap extending between said one and another ends closely adjacent to said pair of side panels and to said bottom panel so as to be concealed thereby, and wherein at least one of said side panels and said bottom panel includes plural slits spaced-apart in the direction of said accessory strap, said accessory strap being extended through said slits so as to expose regions thereof corresponding in number to said plural pairs of slits, whereby items may be attached to said exposed regions.

4. A sport bag as in claim 3, further including a carrying strap, and means for coupling said carrying strap to said bag so that the latter is supported by the former.

5. A sport bag as in claim 4, wherein said coupling means permits said bag to be supported by means of said carrying strap in one of a plurality of possible support configurations in dependence upon user selection of a particular combination of support point(s) associated with said bag, said means for coupling readily facilitating conversion of said bag between one and another of said support configurations.

6. A sport bag as in claim 5, wherein said coupling means is comprised of hooks attached to each end of said carrying strap, and a series of hooks and a portion of said carrying strap intermediate said hooks being coupled to said attachment points in one of said plural possible support configurations.

7. A sport bag as in claim 6 wherein said carrying strap includes means for adjusting the length thereof.

8. A sport bag as in claim 4, further comprising a cover panel joined to said back panel so that said cover panel is capable of covering said interior space.

9. A sport bag as in claim 8 wherein said cover panel includes releasable clasp means for releasably securing said cover panel to said front panel.

* * * * *